United States Patent [19]

Zodrow et al.

[11] Patent Number: 4,950,350

[45] Date of Patent: Aug. 21, 1990

[54] MACHINE FOR LABELLING BOTTLES

[75] Inventors: Rudolf Zodrow, Düsseldorf; Wolfgang Rogall, Wuppertal, both of Fed. Rep. of Germany

[73] Assignee: Holstein und Kappert AG, Dortmund, Fed. Rep. of Germany

[21] Appl. No.: 315,885

[22] Filed: Feb. 24, 1989

Related U.S. Application Data

[63] Continuation-in-part of Ser. No. 197,653, May 23, 1988.

[30] Foreign Application Priority Data

May 23, 1987 [DE] Fed. Rep. of Germany ..... 3717463
Feb. 25, 1988 [DE] Fed. Rep. of Germany ..... 3805854
Mar. 3, 1988 [DE] Fed. Rep. of Germany ..... 3806919

[51] Int. Cl.[5] ..... B65C 3/14; B65C 9/04

[52] U.S. Cl. ..... 156/456; 156/458; 156/567; 156/DIG. 12; 156/DIG. 26; 198/379; 198/478.1

[58] Field of Search ..... 156/567, DIG. 12, DIG. 25, 156/DIG. 26, DIG. 27, 448, 456, 458; 198/379, 478.1

[56] References Cited

U.S. PATENT DOCUMENTS 3,934,714 1/1976 Mastsumoto ..... 198/379
4,143,754 3/1979 Eldred ..... 156/567
4,594,123 6/1986 Eder ..... 156/456
4,721,544 1/1988 Zodrow et al. ..... 156/567

FOREIGN PATENT DOCUMENTS 3308489 9/1984 Fed. Rep. of Germany ..... 156/567

*Primary Examiner*—Michael Wityshyn
*Attorney, Agent, or Firm*—Nils H. Ljungman

[57] ABSTRACT

This invention relates to a labelling machine for bottles which includes a bottle feeding mechanism to feed the bottles to a revolving bottle support platform. The support platform directs bottles to a labelling mechanism and an application mechanism prior to their removal by a bottle withdrawing mechanism. The bottles are maintained against undesired rotation on the support platform by axial force on the top of each bottle to produce contact between the bottom of each bottle disposed on a support plate for each bottle turntable on the revolving bottle support platform. The support plate includes a base portion and upper surface element having an upper contour in a central region thereof. The upper contour matches the bottom of the bottle for receipt of the bottom therein. The upper surface element is removably mounted on the base portion of the support plate and includes features for centering the upper surface element and the upper contour thereof on the base portion of the support plate.

18 Claims, 4 Drawing Sheets

MACHINE FOR LABELLING BOTTLES

CROSS REFERENCE TO RELATED APPLICATIONS

This application is a continuation-in-part of pending prior application Ser. No. 197,653, entitled "MACHINE FOR LABELING BOTTLES OR THE LIKE", filed on May 23, 1988.

BACKGROUND OF THE INVENTION

1. Field of the Invention:

This invention relates to a bottle labelling machine and, more specifically, to a support plate for a bottle turntable in such a labelling machine which includes means for insuring that bottles secured thereon will not be subjected to undesired rotation during the labelling process.

Still further, this invention relates to such a machine which includes the support plate for a turntable in the handling machine for objects, such as a labelling machine for containers or bottles, wherein on the upper surface of the support plate, in particular a non-slip upper surface, there is a contour which matches the supported bottom of the object to be handled or labelled.

2. Description of the Prior Art:

To label bottles in labelling machines, it is customary to support the bottles axially between the bottom and top of the bottle so that they will not rotate. The bottle should be supported within the machine against undesired rotation so that the label can be transferred to the bottle during controlled rotating movement by the machine and, after the label is applied, can be pressed completely against the surface of the bottle by applicator mechanisms, such as brushes. The precision with which this is conducted depends, among other things, on how securely the bottles can be prevented from undesired rotation. Since the controlled rotary movement is produced through frictional contact between the bottle and the bottle turntable upon which the bottle is axially supported, it is not unusual to take special precautions to keep the bottle from slipping on the turntable. The danger of slipping is particularly great, because lubricants and water are used to wet the bottle on the conveyor mechanisms, e.g. plate conveyors, upstream of the labelling machine.

To prevent the bottles from slipping on the bottle turntable, the prior art includes the use of solutions which are intended to clean the bottom of the bottle before the bottle is placed on the bottle turntable. The prior art also includes the use of solutions which are intended to clean the bottle turntable as well.

These measures can be employed as an alternative to, or in addition to, the conventional precautions taken involving the turntable itself.

For example, one prior art device utilizes a support plate for bottle turntables in which radial grooves are introduced into the surface of an elastic body of the support plate which consists of solid rubber. Since the elastic body of such a support plate does not conform to the bottom of the bottle, it is impossible to achieve a 100% frictional engagement therebetween even if the bottle is secured to the support plate by a large axial force. This is particularly true if the bottom of the bottle and/or the contact surface of the support plate is wet or has a coating of lubrication as discussed in German Utility Model DE-GM 660 77 56.

Significantly better results have been achieved with a bottle turntable in which the elastic body of a support plate mounted thereon includes an elastic coating in which sharp-edged bodies or grains are imbedded. Because of the elastic material, this support plate is capable of conforming to the shape of the bottom of the bottle. On the other hand, the sharp-edged bodies which project out of the surface under axial pressure are hooked or engaged in the microfractures on the surface of the bottom of the bottle. The increased frictional engagement achieved in this manner, when compared to other support plates of the prior art, tends to meet the basic requirements for a non-slipping coupling between the support plate and the bottle. This non-slipping condition can only be achieved, however, if the bottle is axially braced with a relatively high axial force between bottom and top. Another disadvantage of such a support plate is that it is relatively expensive to manufacture. As a practical matter, such support plates do not last long in service, because during operation, the small, hard, sharp-edged bodies or grains are easily torn from the support plate as discussed in German Patent No. DE 35 14 239 Cl. In practice, however, it has been found that a uniform elasticity of the elastic body is only possible when the sharp-edged bodies are imbedded in the upper region. Therefore, it is not uncommon to initially form a rod of elastic material with imbedded, sharp-edged bodies evenly distributed throughout. Such a rod is then cut into discs which serve as the elastic bodies for use in the support plates on bottle turntables. Since, as a rule, these discs which serve as elastic bodies are attached with adhesive to a pot-shaped support to form the support plate, it is difficult to achieve a permanent adhesive bond between the elastic bodies and the support.

For the correct labelling of objects, such as bottles, in a labelling machine, during the application of the label to the surface of the bottle, the bottle must not only be in a specified rotational position, sometimes connected with a pivoting movement, but must also be held centered on the turntable. Moreover, the machine must be capable of handling not only bottles of a single format, but also of labelling bottles of different formats with different labels.

To satisfy these requirements, the prior art discloses equipping the turntables in labelling machines with support plates, which not only have non-slip upper surfaces, but also have a contour which matches the bottom of the bottle to be supported and handled. When the format or shape of the bottle to be labelled is changed, it is also necessary to change the support plate. As long as the bottles to be labelled are rotationally symmetrical, changing the support plate presents no problems from the point of view of controlling rotation. However, if the bottle to be labelled is not rotationally symmetrical, such as with molded bottles having a rectangular bottom, care must be taken when changing the support plate to insure that it is connected to the drive mechanism in the correct rotational position. Otherwise there is no way to guarantee a correct rotational position of the bottles for labelling (German Utility Model No. 86 24 351.9).

OBJECTS OF THE INVENTION

This invention relates to a bottle labelling machine including means, in the form of a support plate for a bottle turntable of the machine, for preventing undesired relative rotation of the bottle during labelling.

It is an object to provide such a support plate for bottle turntables in labelling machines, which includes an elastic body with hard material imbedded therein, which is exposed on the contact surface of the support plate.

The object of the invention is to create a support plate which lasts longer and is more economical to manufacture than those of the prior art. A greater frictional engagement is also achieved relative to the axial force required.

Another object of this invention is to provide such a support plate for a turntable in a handling or labelling machine for objects in which an adjustment for different sizes and shapes of objects to be handled or labelled can be made in a simple, effective manner without major expense or effort.

SUMMARY OF THE INVENTION

These and other objects are achieved in a preferred embodiment of the invention including a support plate in which several blockshaped friction bodies made of a relatively hard material are held in the elastic body of the support plate by a positive or frictional engagement.

It has been shown that such a support plate, with a comparatively low axial force, can produce a frictional engagement between the support plate and the bottom of the bottles which is better than can be achieved with the prior art configurations. The design and construction of the support plate according to the invention is simpler than that of the prior art, because the individual blockshaped friction bodies need only be cast into a single elastic material. In the prior art it was necessary either to design the support plate with a different distribution of the sharp-edged bodies or grains in the elastic material, or to cut individual discs from rod material with uniformly distributed sharp-edged grains. Since, in the present invention, only a few block-shaped friction bodies are imbedded in the elastic body, they can be deliberately anchored. This is not possible with the irregular, small bodies employed in the prior art devices. As a result, the preferred support plate is not subject to rapid wear. Finally, no high axial pressure is required, because the elastic material of the preferred support plate tends to yield easily under pressure. As a result, the axial pressure can be concentrated on the blockshaped friction bodies where it is needed because of the frictional engagement produced thereby. Since only a small quantity of the elastic material remains below the block-shaped bodies, the necessary support force and, therefore, the pressure on the blockshaped friction bodies required for the frictional engagement can be achieved in a short distance. With proper tolerances, it is possible to achieve the required support force in a short distance, while producing the pressure on the block-shaped friction bodies necessary for the frictional engagement.

According to a first configuration of the invention, the block- shaped friction bodies are oblong or elongated in shape, and are oriented radially in the elastic material. With this configuration, a wider range of diameters of the bottle can be accommodated.

To better anchor the block-shaped friction bodies in the elastic body, on the one hand, and to achieve a large support surface in the elastic material with a small contact surface on the bottom of the bottle, on the other hand, a preferred configuration for the blockshaped friction bodies of the invention is employed. The preferred friction bodies have a transverse, dovetail-shaped cross section and lie with their larger base surface in the elastic body and their smaller base surface on the upper surface of the support plate. Theoretically, it is possible to use a foam material for the elastic body. For the support plate according to the invention, however, it is desirable to use an incompressible material, preferably such as solid rubber, as the elastic material. When an incompressible material, when compared to foam material, is used, however, it is still necessary for it to experience a certain amount of yield, so that when pressure is applied to the support plate, the elastic material can yield and the friction bodies can project therefrom. Primarily for this purpose, one configuration of the invention utilizes open spaces in the surface of the elastic body at the edge of the block-shaped friction bodies. There can also be provided open spaces below the block-shaped friction bodies in the elastic body.

To be able to use identical block-shaped friction bodies in support plates having different diameters, it is appropriate for the block-shaped friction bodies to include bevelled side edges on their ends facing the center of the support plate. With this configuration for the friction bodies, even at the points of least separation, there remains sufficient elastic material between the individual block-shaped friction bodies to allow them to move independently of one another. To provide a particularly permanent connection within the support plate between the elastic material and its support, which, as a rule, is flat, one configuration of the invention includes the elastic body sitting within a flat, pot-shaped support and positively connected to the wall of the support. The positive connection can be achieved with projections or recesses, preferably holes, located in the wall of the support which are engaged by the elastic body.

To enable the bottles to be pushed onto the support plate of the bottle turntable without snagging and tipping, in another configuration of the invention, the exposed surfaces of the blockshaped friction elements or bodies lie in the plane of the surrounding exposed surface of the elastic body.

The bottle can be held by frictional engagement to prevent rotation on the turntable with a relatively low axial force if, as in another configuration of the invention, the exposed surfaces of the elastic body in the areas between the friction bodies are recessed below the exposed surfaces of the friction bodies.

This recess can preferably be provided when the support plate is manufactured by using castable material for the manufacture of the elastic body which contracts as it sets. It has been found that in the areas between the friction bodies, which consist exclusively of the elastic material, the contraction effect causes the surface to recede more severely than in the immediate vicinity of the friction bodies. Since the same effect also occurs at the outer edges of the support plate where the elastic body is reinforced by the wall of the pot-shaped support, the exposed surface at the upper side of the edge of the support plate tends to be in a common plane with the exposed surface of the friction bodies. As a result, the bottles can be pushed onto the support plate without snagging or tipping.

This invention relates to a labelling machine for a plurality of bottles comprising of an arrangement for labelling the abovementioned bottles. One aspect of the invention resides in a bottle support platform for supporting and advancing these bottles to the abovementioned arrangement for labelling. This bottle support platform has a plurality of bottle turntables mounted thereon. In turn, there is a support plate mounted on each of these bottle turntables to prevent relative rotation therebetween. Each of these support plates have an upper surface for receiving a bottom of one of the bottles thereon and a bottle feeding apparatus for sequentially feeding these bottles onto the upper surface of each support plate.

Another aspect of the invention involves a bottle removing device for sequentially removing the above-mentioned bottles from the upper surface of each support plate. Yet another aspect of the invention is a bottle support platform including an arrangement for selectively retaining a top of the bottle when the bottle has been positioned on the upper surface of the support plate by the bottle feeding device prior to advancement to the arrangement for labelling. This arrangement for selectively retaining the top is capable of producing an axial force between the bottom of the bottle and the upper surface of the support plate. A further aspect of the invention resides in the support plate which includes an elastic body and a plurality of block-shaped friction bodies being resiliently supported by the elastic body with each of the friction bodies being embedded and held therein. Each of the friction bodies have an exposed, friction surface which lies generally in the upper surface of the support plate.

A yet further aspect of the invention resides in the axial force producing frictional contact between the bottom of the bottle and the plurality of the friction surfaces to prevent relative rotation between one of the bottles and the bottle turntable.

Still further the objects of the invention can be provided on a preferred support plate of the labelling machine the type describe above including a contour which is formed from the inside edge of an interchangeable ring placed on the support plate. The preferred interchangeable ring is centered and removably fastened by means of holding elements engaged on the outside edge of the support plate.

In contrast to the prior art, changing the size or shape of the bottle to be labelled in an apparatus in accordance with the invention does not require changing the entire support plate, but only the preferred interchangeable ring. Therefore, the expense and effort associated with a format or size change, in relation to the parts which must be kept on hand and the work connected with the change itself, can be reduced.

The change can be made easily without tools, if the preferred holding elements for the ring are designed as elastic clamps, which are engaged on the underside of the support plate by means of a lug.

In one embodiment of the invention, the centering of the interchangeable ring can be accomplished without additional effort or expense, since the holding elements are located in at least three circumferential positions, offset from one another, on the outside edge of the support plate.

If it were only a question of centering rotationally symmetrical objects of different sizes, the rotational position of the interchangeable ring on the support plate would be irrelevant. If, however, different-size objects must be held in a specified rotational position on the support plate, it is necessary for the interchangeable ring to be fastened on the support plate in a clearly defined rotational position. Such a defined position can be achieved, for example, in one embodiment by providing guides on the outside edge of the support plate for the holding elements of the interchangeable ring. However, a preferred embodiment includes significantly more advantageous solution in which an adapter frame or plate for the interchangeable ring is fastened on the support plate. The preferred adapter frame or plate can be fixed in different rotational positions and has guides for the holding elements for the interchangeable ring located on the outside edge of the support plate. When the turntable is coupled to the drive mechanism, it is possible, by means of the adjustable adapter frame, to specify a rotational position for the interchangeable ring which is suitable for the object to be handled during the subsequent rotational movement thereof.

Constructively, the adjustability of the adapter frame can be preferably provided by holding the frame to the underside of the support plate by means of set screws which are engaged through slots.

In accordance with another embodiment of the invention, the guides are designed as grooves, in which the holding elements of the interchangeable ring are engaged in a form-fitting manner.

The objects of the invention are also provided by a labelling machine for a plurality of bottles or the like comprising equipment for labelling the bottles. A bottle support platform is for supporting and advancing the bottles to equipment. The bottle support platform has a plurality of bottle turntables mounted thereon. A support plate has a base portion and is mounted on each of the bottle turntables to prevent relative rotation therebetween. Each of the support plates has an upper surface element having an upper contour in a central region thereof. The upper contour matches a bottom of one of the bottles for receipt of the bottom therein. The upper surface element is removably mounted on the base portion and includes features for centering the upper surface element and the upper contour thereof on the base portion. There is included bottle feeding apparatus for sequentially feeding the bottles onto the upper surface element of each support plate and bottle removing apparatus for sequentially removing the bottles from the upper surface element of each support plate. The bottle support platform includes a device for selectively retaining a top of the one bottle when the bottle has been positioned on the upper surface element of the support plate by the bottle feeding apparatus prior to advancement to labelling equipment. The device for selectively retaining the top is capable of producing an axial force between the bottom of the one bottle and the upper surface element of the support plate to prevent relative rotation between the one bottle and the bottle turntable.

The invention also includes a bottle support plate including a base portion which is mounted for rotation on a turntable of a bottle labelling machine or the like. The support plate includes an upper surface element having an upper contour in a central region thereof. The upper contour matches a bottom of the bottle for receipt of the bottom therein. The upper surface element is removably mounted on the base portion and includes features for centering the upper surface element and the upper contour thereof on the base portion of the support plate.

The invention is explained in greater detail below by means of the embodiments, with reference to the accompanying drawings.

DESCRIPTION OF THE PREFERRED EMBODIMENTS

Figure 1:
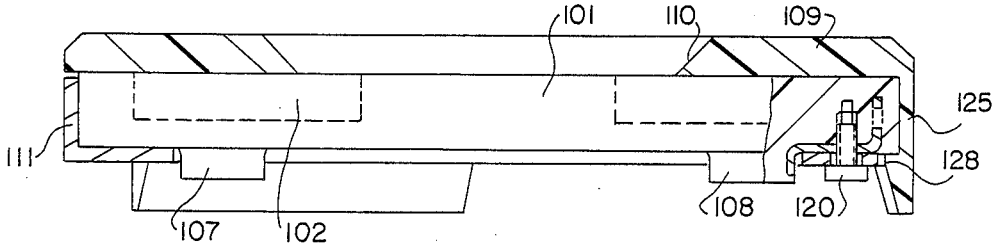
FIG. 1 is a fragmentary, sectional view of a support plate for a turntable including the preferred interchangeable ring mounted thereon as generally seen along Line I—I in FIG. 2.
Figure 2:
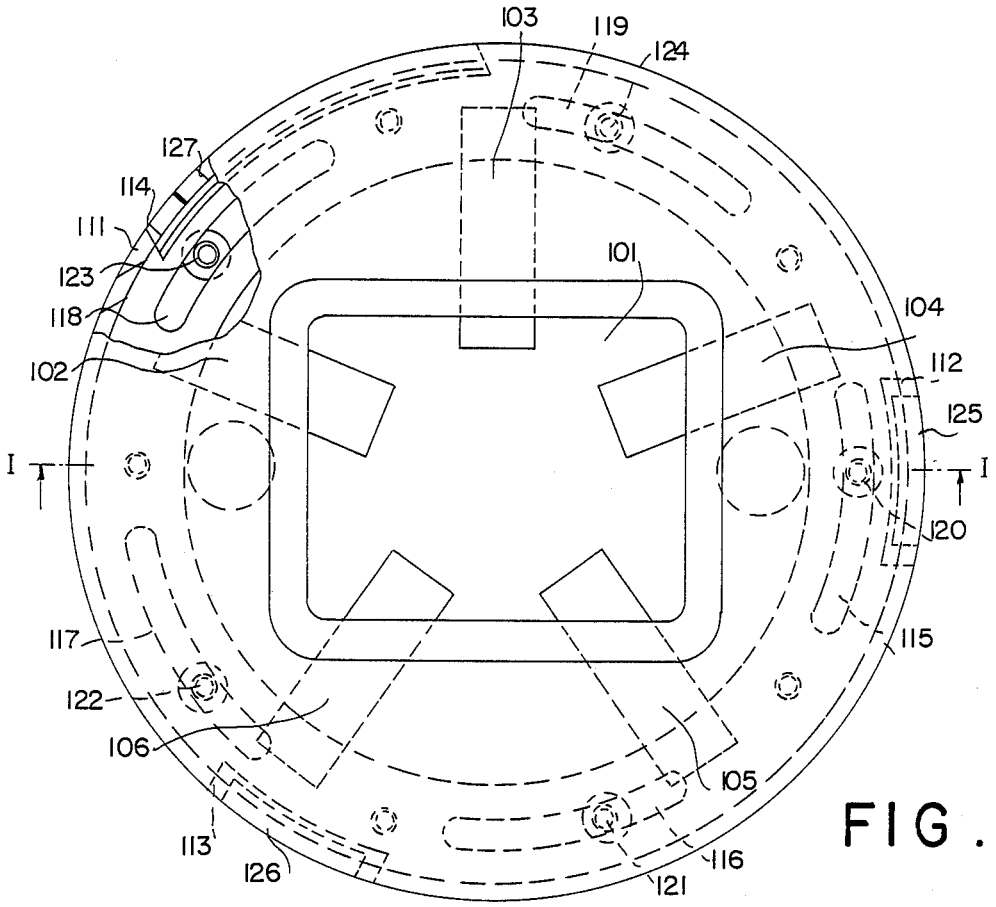
FIG. 2 is a plan view partially in section of the support plate and interchangeable ring as illustrated in FIG. 1.

As seen in FIGS. 1 and 2, the preferred support plate 101 consists of a plastic plate in the form of a flattened cylinder having a plurality of block-shaped friction bodies 102 to 106 made of hard material embedded therein in a radial pattern. The plate 101 has on its underside two projections 107, 108, which are used together with a screw connection to connect the plate 101 to a base plate which is connected to the drive mechanism of a labelling machine, as discussed hereinbelow. The support plate 101 is similar to the support plate 34 which is described in detail with particular reference to FIGS. 3 through 8 hereinbelow.

On the support plate 101 is mounted a preferred interchangeable ring 109 having an inside edge 110 which forms a profile which is, in this particular embodiment, a rectangle to match the bottom of the object to be handled. The interchangeable ring 109 leaves an exposed area in the central region of the support plate 101, on which the bottom of the object to the handled sits. The object is therefore held in a form-fitting manner by the interchangeable ring 109.

A preferred adapter frame or plate 111 is fastened to the support plate 101. The adapter frame 111 includes at least one of these guides 112, 113, 114 designed as grooves on the outside edge of the support plate 101 and at least one of a plurality of slots 115 to 119 which are concentric to the support plate 101 and located on the underside of the support plate 101. A corresponding plurality of set screws 120 to 124 respectively extend through the slots. Because of the fastening of the adapter frame 111 by means of the slots 115 to 119 and the screws 120 to 124, it is possible to twist or rotate the adapter frame 111 with its guides 112, 113, 114 in relation to the support plate 101 and to fix it in a specified rotational position.

The preferred interchangeable ring 109 is formed of an elastic material and, more significantly includes on its outside edge elastic clamps 125, 126, 127. The clamps 125, 126, 127 are aligned with and held in a form-fitting manner respectively in the grooveshaped guides 112, 113, 114, and are engaged on the underside of the support plate 101 by means of lugs 128 at the lower ends thereof. By means of the adapter frame 111, which can be fastened in a specified rotational position, it is possible to adjust the rotational position of the interchangeable ring 109 to be consistent with the torsional control as required by the drive mechanism without the need for any intervention in or alteration of the drive coupling. When there is a change in the bottle format or size, the one-time adjustment of the adapter frame 111 also tends to pre-set the rotational position for other interchangeable rings. Therefore, after each format or size change, there may not be any need for a new setting of the rotational position.

Figure 7:
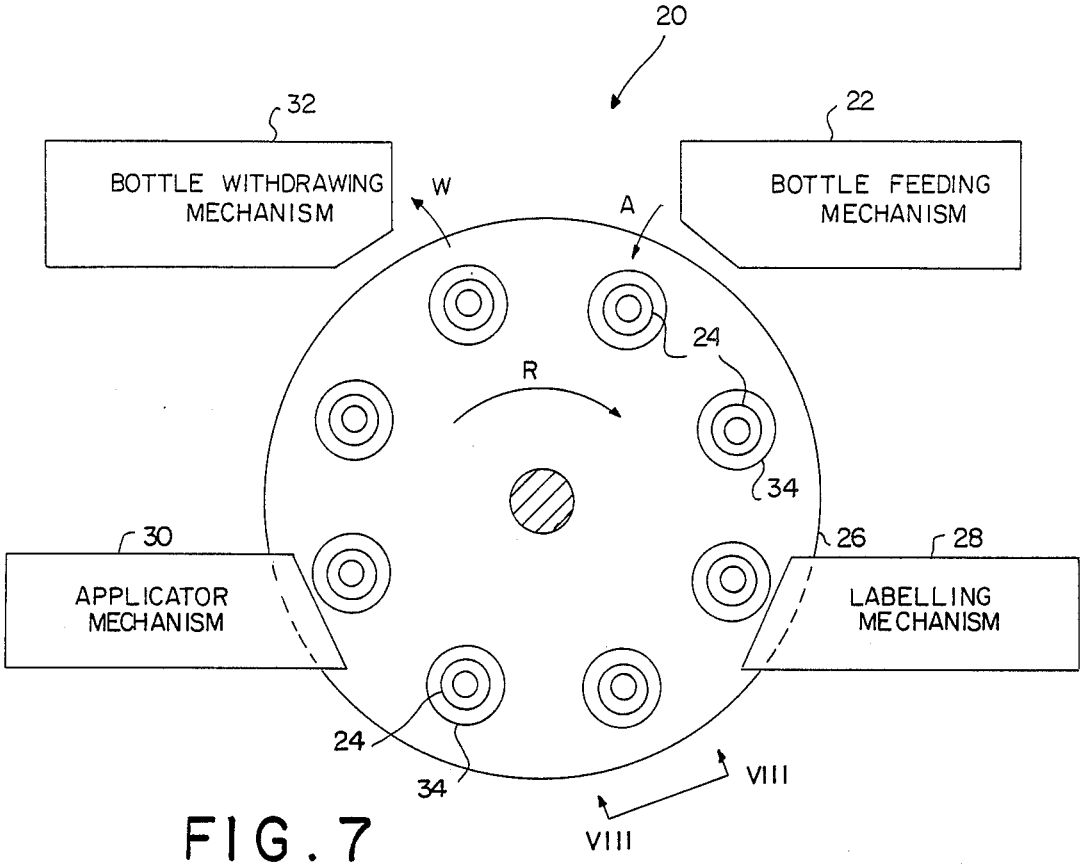
FIG. 7 shows a schematic top view of a labelling machine including various features of the invention.
Figure 8:
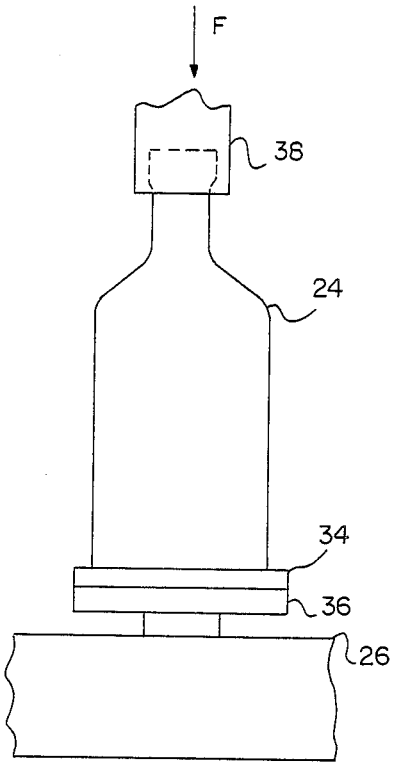
FIG. 8 shows a schematic view of the machine of FIG. 7 as seen along Line VIII—VIII.

As seen in FIGS. 7 and 8, a typical labelling machine 20 is shown in schematic form. Typically, such labelling machines 20 include a bottle feeding mechanism 22 for advancing the bottles 24 as indicated by the arrow A. The bottles 24 are sequentially positioned by the bottle feeding mechanism 22 on a revolving bottle support platform 26 for advancement in a direction as indicated by the arrow R to a labelling mechanism 28. After a label is applied to the bottle 24 by the labelling mechanism 28, continued rotation of the platform 26 in the direction R advances the bottle 24 to an applicator mechanism 30 which insures that the label is properly pressed and applied to the surface of the bottle 24. Continued revolution of the bottle support platform 26 causes the bottle 24 to be directed to a bottle withdrawing mechanism 32 for removal of the bottles 24 from the revolving platform 26 as indicated by the arrow W.

As best seen in FIG. 8, each bottle 24 is initially positioned on a support plate 34 of the revolving platform 26. Specifically, the support plate 34 is mounted on a bottle turntable 36 which is adapted for controlled movement of the bottle 24 relative to the revolving platform 26. Although not shown in FIG. 7, it can be seen in FIG. 8 that, after initial positioning of the bottle 24 on the support plate 34, an upper support mechanism 38 is lowered against the top of the bottle 24 to produce a downward force F thereon as the bottle proceeds to the labelling mechanism 28 and the applicator mechanism 30. The upper support mechanism 38 is retracted prior to removal of the bottle 24 from the platform 26 at the bottle withdrawing mechanism 32.

Specifically, as will be discussed in detail hereinbelow, the upper support mechanism 38 is intended to produce the axial force F on the top and the bottom of the bottle 24 to create frictional contact and to prevent undesired relative rotational movement between the bottom of the bottle 24 and the support plate 34.

The preferred support plate 34 illustrated in FIGS. 3 through 6 comprises an elastic body 1 and elongated, block-shaped, rigid friction bodies 2 imbedded in the elastic body 1 for positive engagement therebetween. The block-shaped friction bodies 2 can be manufactured of corundum material. Corundum is a mineral having $Al_3O_3$ in its chemical composition, a hardness factor of preferably about 9.0, and a density of preferably about 3.9 to 4.1 g/cm$^3$. Normal corundum as preferably diamond spar is cloudy to grey in color. The friction body 2 can also be made of a mineral mixture of corundum, magnetite, quartz, etc. This mineral mixture is used as a lubricating gel or abrasive. For example, corundum is also manufactured industrially as an abrasive and is known by the trade name AMARYL. This material or any reasonable alternative material selected for the friction bodies 2 should, as discussed in detail hereinbelow, prevent undesired slipping of the bottles on the surface of the support plate.

The elastic body 1 is supported by a flat, pot-shaped support 3. By means of a thin layer 4, the elastic material of the basic body 1 also surrounds the wall 5 of the pot-shaped support 3. Preferably, the elastic material forming the layer 4 and the remainder of the elastic body 1 is vulcanized onto the pot-shaped support 3. To achieve a better connection, the surface of the pot-shaped support 3 can be sandblasted. To improve the connection, whether the support 3 is sandblasted or not, there are included a plurality of holes 18 in the wall 5 of the pot-shaped support 3 which holes 18 are filled by the elastic material during formation of the body 1. The base 6 of the pot-shaped support 3 has, on its underside, projections 9, which are capable of being engaged in corresponding recesses (not shown) in an upper surface of the bottle turntable 36 in the labelling machine 20. In the center of the elastic body 1 and the base 6 of the support plate 34, a hole is provided for receiving a bolt (not shown) to secure the support plate 34 to the bottle turntable 36.

The friction bodies 2 are evenly dispersed around and radially oriented in the elastic body 1 of the elastic support plate 34. On the ends of the friction bodies 2 toward the center, the corners 7, 8 are bevelled. Support plates with friction bodies 2 configured in this manner may be loaded more densely than support plates with friction bodies with projecting corners. As seen in the cross sectional view of FIG. 5, the friction bodies 2 have a dovetailshaped cross section. The larger base surface of the friction body 2 is in contact with the elastic body 1 at a relatively thin layer 10 having a central hole 11 therethrough. The smaller upper surface 12 lies in the plane of the exposed surface 13 of at least the immediately adjacent region of the elastic body 1. In this manner, an elastic support of the rigid friction body 2 is provided and, because of the relatively thin layer 10, a great deal of pressure can be producted by a short distance of compression. Because some areas of the exposed surface 13 include recesses 19 in the elastic material, it is possible, even if, as discussed hereinabove, an incompressible material is used, to cause the elastic material of the body 1 to yield as required for the elasticity. The smaller upper surface 12, on the other hand, produces a higher surface pressure on the contact regions of the bottom of the bottle 24. The dovetail shape of the friction bodies 2 ensures that the friction bodies 2 remain permanently anchored within the elastic body 1. To enable the substantially incompressible rubber material to also yield in the immediate vicinity of the friction bodies 2, the friction bodies 2 are surrounded by narrow and shallow recesses 14–17 in the surface 13 of the elastic body 1.

Since the rigid friction bodies 2 are distributed over the surface 13 of the support plate 34, the base of the bottle 24 is pressed against the smaller upper surface 12 of the friction bodies 2 at only a few locations, but with a relatively high surface pressure. Because of the thin elastic layer 10, the friction bodies 2 can yield only to accommodate specified tolerances. The compression force F necessary for the frictional engagement is therefore obtained with very little yield of the friction body 2 on the layer 10. Since the surface area of the bottom of a bottle 24 which interacts with the upper surfaces 12 of the friction bodies 2 is small, only a slight axial force is required to produce a high surface pressure. Since, in contrast to the prior art support plate which employs individually imbedded, small, sharp-edged grains or bodies, the friction bodies 2 can yield only a small amount, an effective frictional engagement is produced even though there is a low axial force. Because of the rigidity of the friction bodies 2 in the support plate 34 according to the invention small particles will not break off the friction bodies 2, as was the case with the individual sharp-edged grains or bodies embedded in the elastic coating of the prior art devices. As a result, the service life of the preferred support plate 34 according to the present invention is longer.

Figure 4:
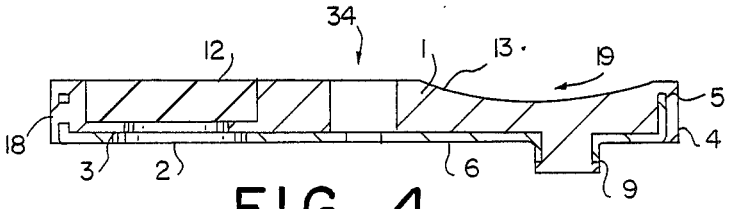
FIG. 4 shows the support plate as in FIG. 3, in cross section along Line IV—IV.
Figure 3:
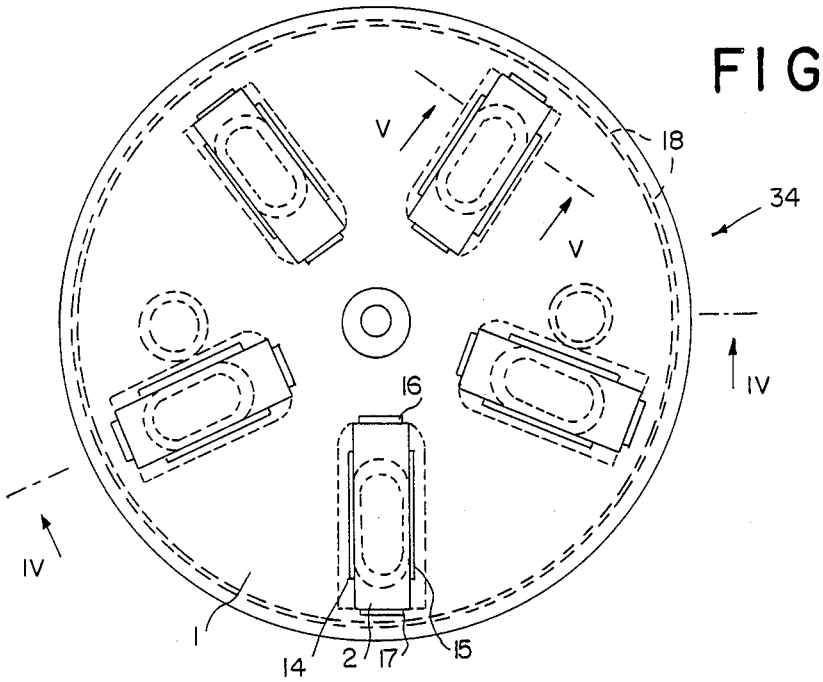
FIG. 3 shows a plan view of a support plate including various features of the invention.
Figure 6:
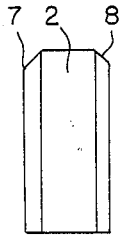
FIG. 6 shows a plan view of a preferred block-shaped friction body of the present invention.
Figure 5:
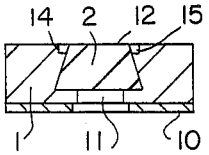
FIG. 5 shows the support plate as in FIG. 3, in partial cross section along Line V—V in FIG. 3.

Theoretically, of course, it would be possible to design the elastic body 1 with a totally planar surface. However, for a better frictional engagement between the bottom of the bottle and the friction bodies 2, it is preferable, in the areas of the elastic body 1 between the individual friction bodies 2, as shown in FIG. 4, for the exposed surface 13 to be somewhat recessed relative to the exposed upper surfaces 12 of the friction bodies 2. These recesses 19 can be easily produced during manufacture by using castable material for the elastic body 1 which contracts when it sets. In the areas of the elastic body 1 between the friction bodies 2 which are free of inserts and reinforcements, the contraction of the material is greater than in the areas immediately adjacent to the friction bodies 2 and the wall 5 of the pot-shaped support 3. The advantage of such a configuration is that the bottles can be pushed, without tipping and snagging, over the surface 13 at the peripheral regions which lie in a common plane with the upper surface 12 as they are being positioned onto the friction bodies 2.

It should be clear from the drawings and the description provided hereinabove that a preferred support plate for a bottle turntable in labelling machines includes an elastic body with a hard, friction material imbedded therein. The friction material is exposed on the support surface of the support plate and is characterized by the fact that several block-shaped friction bodies 2 made of the hard material are distributed in the rubber-elastic body 1 and are held in place by positive or frictional contact. The support plate is characterized by the fact that the block-shaped friction bodies 2 are oblong or elongated and are oriented radially in the rubber-elastic body 1. The ends of the friction bodies 2 facing the center of the support plate may have bevelled corners 7, 8. In addition, the friction bodies can have a transverse, dovetail-shaped cross section. Their larger base surface is in the elastic body 1, and their smaller base surface 12 lies on the surface of the support plate. The material of the elastic body 1 is incompressible, in particular solid rubber. There may be included open spaces 14–17 in the surface 13 of the elastic body 1 at the edge of the friction bodies 2. Additionally, there may be included open spaces 11 in the elastic body 1 under the friction bodies 2. Preferably, the elastic body 1 sits in a flat, pot-shaped support 3 and is positively connected with the wall 5 of the support 3. In one embodiment, the support plate includes, for the positive connection, the wall 5 having projections or recesses, in particular holes 18. The friction bodies may be positioned with their exposed surface 12 in the plane of the surrounding exposed surface 13 of the elastic body 1. The exposed surface 13 of the support plate may be recessed, in the areas of the elastic body 1 between the friction bodies 2, in relation to the exposed surfaces 12 of the friction bodies 2. For such a configuration, the material of the elastic body 1 is castable and contracts as it sets.

Typical bottle labelling machines include Models JOWE-9, JOWE-15, and JOWE-50 manufactured by Johann Weiss of Berlin, West Germany: the KRONES ULTRAMATIC manufactured by Hermann Kronseder of Neutraubling, West Germany; Models ALPHA 45 and ALPHA 60 manufactured by Carl Pirzer GmbH & CO. of Neutraubling, West Germany.

Additionally, bottle labelling machines are disclosed in the following U.S. Pat. Nos.:

| U.S. PAT. NO. | TITLE |
|---|---|
| 4,283,245 | BOTTLE LABELLING APPARATUS |
| 4,306,926 | BOTTLE LABELING MACHINE AND METHOD |
| 4,430,141 | MACHINE FOR LABELING OBJECTS, ESPECIALLY BOTTLES |
| 4,445,961 | LABELING APPARATUS FOR BOTTLES OR THE LIKE |
| 4,512,842 | LABELING MACHINE |

These United States Patents are incorporated by reference as if the documents were set forth herein in their entirety.

In summary, the invention includes a support plate 101 for a turntable in a handling machine for objects, in particular a labelling machine for bottles, with a contour 110 on its upper surface, in particular a non-slip surface. The contour 110 matches and supports the bottom of the object to be handled. The contour 110 is formed of the inside edge of an interchangeable ring 109 placed on the support plate 101, centered and removably fastened by means of holding elements 125, 126, 127 which are engaged on the outside edge of the support plate 101.

The support plate is further characterized by the fact that the holding elements 125, 126, 127 are designed as elastic clamps, which engage the underside of the support plate 101 by means of a lug 128. The holding elements 125, 126, 127 are supported in at least three circumferential positions, offset from one another, on the outside edge of the support plate 101. On the outside edge of the support plate 101, there is at least one guide 112, 113, or 114 for each holding element 125, 126, or 127 for the interchangeable ring 109.

The support plate is further characterized by the fact that fastened on the support plate 101 is an adapter frame 111 for the interchangeable ring 109 which can be adjusted in various rotational positions. The ring 109 has at least one guide 112, located on the outside edge of the support plate 101, for at least one holding element 125 of the interchangeable ring 109. The adapter frame 111 is held on the underside of the support plate 101 by means of set screws 120 to 124 which are engaged through slots 115 to 119 of the adapter frame 111. Each guide 112, 113, or 114 in the adapter frame 111 is designed as a groove, in which the holding element 125, 126, or 127 of the interchangeable ring 109 is form-fitted.

The invention as described hereinabove in the context of a preferred embodiment is not to be taken as limited to all of the provided details thereof, since modifications and variations thereof may be made without departing from the spirit and scope of the invention.

What is claimed is:

1. A labelling machine for a plurality of bottles comprising:

means for labelling said bottles;

a bottle support platform for supporting and advancing said bottles to said means for labelling;

said bottle support platform having a plurality of bottle turntables mounted thereon;

a plurality of support plates, each support plate having a base portion;

a said support plate being mounted on each of said bottle turntables to prevent relative rotation between each of said support plates and a respective said bottle turntable;

each of said support plates having an upper surface means;

each said upper surface means having an upper contour in a central region thereof;

said upper contour matching a bottom of a said bottle for receipt of a said bottom therein;

each said support plate having means for removably mounting a said upper surface means on said base portion thereof;

each said means for removably mounting including means for centering a said upper surface means and a said upper contour thereof on a said base portion;

bottle feeding means for sequentially feeding said bottles onto said upper surface means of each said support plate;

bottle removing means for sequentially removing said bottles from said upper surface means of each said support plate;

said bottle support platform including means for selectively retaining a top of a said bottle when a said bottle has been positioned on a said upper surface means by said bottle feeding means prior to advancement to said means for labelling;

said means for selectively retaining a said top being capable of producing an axial force between a bottom of a said bottle and a said upper surface means to prevent relative rotation between said bottles and said bottle turntables; and said means for removably mounting including at least one resilient clamping means for clamping each said upper surface means to a said base portion.

2. A labelling machine for a plurality of bottles comprising:

means for labelling said bottles;

a bottle support platform for supporting and advancing said bottles to said means for labelling;

said bottle support platform having a plurality of bottle turntables mounted thereon;

a plurality of support plates, each support plate having a base portion;

a said support plate being mounted on each of said bottle turntables to prevent relative rotation between each of said support plates and a respective said bottle turntable;

each of said support plates having an upper surface means;

each said upper surface means having an upper contour in a central region thereof;

said upper contour matching a bottom of a said bottle for receipt of a said bottom therein;

each said support plate having means for removably mounting a said upper surface means on said base portion thereof;

each said means for removably mounting including means for centering a said upper surface means and a said upper contour thereof on a said base portion;

bottle feeding means for sequentially feeding said bottles onto said upper surface means of each said support plate;

bottle removing means for sequentially removing said bottles from said upper surface means of each said support plate;

said bottle support platform including means for selectively retaining a top of a said bottle when a said bottle has been positioned on a said upper surface means by said bottle feeding means prior to advancement to said means for labelling;

said means for selectively retaining a said top being capable of producing an axial force between a bottom of a said bottle and a said upper surface means to prevent relative rotation between said bottles and said bottle turntables; and each said means for removably mounting including at least one resilient clamping means joined to a said upper surface means; and said at least one resilient clamping means each having an extended end extending to an underside of a said base portion to secure a said base portion between a said upper surface means and a said extended end.

3. The machine according to claim 2, wherein said at least one resilient clamping means each includes a clamp joined to an edge of a said upper surface means to extend adjacent to a corresponding portion of an outside edge of a said base portion and said clamp has a said extended end and includes a lug at said extended end thereof to overlie said underside of a said base portion.

4. The machine according to claim 3, wherein each said clamp is one of three said clamps and said three clamps are respectively separated one from the other to be disposed about a circumference of a said upper surface means and a said base portion.

5. The machine according to claim 4, wherein each said upper surface means and said three clamps thereof are integrally formed of an elastic material.

6. The machine according to claim 3, further including guide means for guiding each said clamp and each said guide means is disposed to establish a relative circumferential position of a said upper surface means on a said base portion.

7. The machine according to claim 6, wherein each said guide means includes groove means in said corresponding portion of said outside edge of a said base portion for receipt of a said clamp therein.

8. The machine according to claim 7, further including an adapter frame mounted to said underside of each said base portion, wherein each said guide means further includes a groove at an outer edge of a said adapter frame.

9. The machine according to claim 8, wherein each said adapter frame includes slot means and is mounted to said underside of a said base portion by screw means respectively through said slot means.

10. The machine according to claim 9, wherein each said slot means extends generally circumferentially for adjustment of a circumferential position of a said adapter frame relative to a said base portion and said adjustment of said circumferential position is for corresponding circumferential adjustment of said guide means, said clamp, and a said upper surface means on a said base portion of each said support plate.

11. The machine according to claim 2, wherein each said upper surface means includes an opening in a center of said upper contour thereof, each said base portion has a top surface, and a said bottom in said upper contour is aligned with said opening thereof to rest on a said top surface of a said base portion.

12. A bottle support plate, for supporting a bottle having a bottom, including a base portion which is mountable for rotation on a turntable of a bottle labelling machine, said support plate comprising:

upper surface means having a central region;

said upper surface means having an upper contour in said central region thereof;

said upper contour matching said bottom of said bottle for receipt of said bottom therein;

means for removably mounting said upper surface means on said base portion of said support plate;

said means for removably mounting including means for centering said upper surface means and said upper contour thereof on said base portion of said support plate; and said means for removably mounting including at least one resilient clamping means for clamping said upper surface means to said base portion.

13. A bottle support plate, for supporting a bottle having a bottom, including a base portion which is mountable for rotation on a turntable of a bottle labelling machine, said support plate comprising:

upper surface means having a central region;

said upper surface means having an upper contour in said central region thereof;

said upper contour matching said bottom of said bottle for receipt of said bottom therein;

means for removably mounting said upper surface means on said base portion of said support plate;

said means for removably mounting including means for centering said upper surface means and said upper contour thereof on said base portion of said support plate;

said means for removably mounting including at least one resilient clamping means joined to said upper surface means; and said at least one resilient clamping means, each having an extended end extending to an underside of said base portion to secure said base portion between said upper surface means and said extended end.

14. The support plate according to claim 13, wherein said at least one resilient clamping means each includes a clamp joined to an edge of said upper surface means to extend adjacent to a corresponding portion of an outside edge of said base portion and each said clamp has a said extended end and includes a lug at said extended end thereof to overlie said underside of said base portion.

15. The support plate according to claim 14, wherein each said clamp is one of three said clamps and said three clamps are respectively separated one from the other to be disposed about a circumference of said upper surface means and said base portion.

16. The support plate according to claim 14, further including guide means for guiding a said clamp and said guide means is disposed to establish a relative circumferential position of said upper surface means on said base portion.

17. The support plate according to claim 16, wherein said guide means includes groove means in said corresponding portion of said outside edge of said base portion for receipt of a said clamp therein, further including an adapter frame mounted to said underside of said base portion, said guide means further includes a groove at an outer edge of said adapter frame, and said adapter frame includes slot means and is mounted to said underside of said base portion by screw means respectively through said slot means.

18. The support plate according to claim 17, wherein said slot means extends generally circumferentially for adjustment of a circumferential position of said adapter frame relative to said base portion and said adjustment of said circumferential position is for corresponding circumferential adjustment of said guide means, said clamp, and said upper surface means on said base portion of said support plate.

* * * * *

UNITED STATES PATENT AND TRADEMARK OFFICE

CERTIFICATE OF CORRECTION

PATENT NO. : 4,950,350

DATED : August 21, 1990

INVENTOR(S) : Rudolf ZODROW and Wolfgang ROGALL

It is certified that error appears in the above-identified patent and that said Letters Patent is hereby corrected as shown below:

On the title page:

Under the Assignee section, indicated by the INID code [73], delete "Holstein und Kappert, AG" and insert --ETI-TEC Maschinenbau GmbH--. Also, delete "Dortmund, Fed. Rep. of Germany" and insert --Erkrath, Fed. Rep. of Germany--.

Signed and Sealed this

Fifth Day of February, 1991

*Attest:*

HARRY F. MANBECK, JR.

*Attesting Officer*

*Commissioner of Patents and Trademarks*